US006689992B1

(12) United States Patent
Ramos et al.

(10) Patent No.: US 6,689,992 B1
(45) Date of Patent: Feb. 10, 2004

(54) CONNECTOR FOR AN ELECTRICAL HEATING ELEMENT

(75) Inventors: Richard Ramos, La Habra, CA (US); Richard E. Phelan, Huntington Beach, CA (US)

(73) Assignee: SierraTherm Production Furnaces, Inc., Watsonville, CA (US)

( * ) Notice: Subject to any disclaimer, the term of this patent is extended or adjusted under 35 U.S.C. 154(b) by 70 days.

(21) Appl. No.: 10/062,152

(22) Filed: Jan. 31, 2002

(51) Int. Cl.[7] ..... H05B 3/08
(52) U.S. Cl. ..... 219/541; 219/343
(58) Field of Search ..... 219/541, 542, 219/543, 343, 505; 373/132

(56) References Cited

U.S. PATENT DOCUMENTS

| | | | | | |
|---|---|---|---|---|---|
| 4,055,723 | A | * | 10/1977 | Vanderford | 373/132 |
| 4,194,079 | A | | 3/1980 | Noren et al. | |
| 4,628,187 | A | * | 12/1986 | Sekiguchi et al. | 219/505 |
| 4,755,658 | A | * | 7/1988 | Wilsey | 219/541 |
| 4,870,256 | A | * | 9/1989 | Heise et al. | 219/542 |
| 4,927,994 | A | * | 5/1990 | Leger | 219/343 |
| 6,194,692 | B1 | * | 2/2001 | Oberle | 219/543 |

OTHER PUBLICATIONS

B.H. Mackintosh, "Electrical Connector for Graphite Heating Elements," NASA, Contract No. NAS 7–100, Aug. 1982, Jet Propulsion Laboratory, California Institute of Technology, Pasadena, California.

Paul W. Barnes, "Sealing MEMS Devices in Ceramic Packages in a High Vacuum Atmosphere," SST International Technical Bulletin.

* cited by examiner

*Primary Examiner*—Sang Y. Paik
*Assistant Examiner*—Leonid Fastovsky
(74) *Attorney, Agent, or Firm*—Blakely, Sokoloff, Taylor & Zafman LLP

(57) ABSTRACT

An electrical heating element, such as a graphite block, is resiliently held in electrical contact with a support block by a plurality of spring loaded connectors. The support block is electrically connected to an electrode. The spring loaded connectors extend through a plate, the heating element, and the support block. The connectors extend through slot shaped openings in the heating element such that the heating element can move in the direction of its length relative to the plate and the support block to provide a first degree of freedom between the electrode and the heating element. There may be up to six degrees of freedom in the mechanical connection between the electrode and the heating element.

16 Claims, 5 Drawing Sheets

CONNECTOR FOR AN ELECTRICAL HEATING ELEMENT

BACKGROUND OF THE INVENTION

Industrial furnaces, particularly furnaces capable of operating under pressure or vacuum, may use electrical heating elements. For example, graphite can be used as a heating element by passing current through the graphite element. The heating element is typically connected to a metal current carrier which supplies the electrical current and may also provide mechanical support for the heating element.

The heating element and the metal current carrier typically will have different rates of thermal expansion. It is desirable to have a connector that can maintain good electrical contact with the heating element while accommodating the different rates of thermal expansion.

The heating element may take the form of a rectangular block or sheet. The metal current carriers may be connected at the two ends of the heating element, typically the ends that are furthest apart. It is desirable that the connector be adjustable so that the heating element can be attached without inducing mechanical stresses or strains in the heating element, which may be brittle.

DETAILED DESCRIPTION OF THE INVENTION

Figure 1:
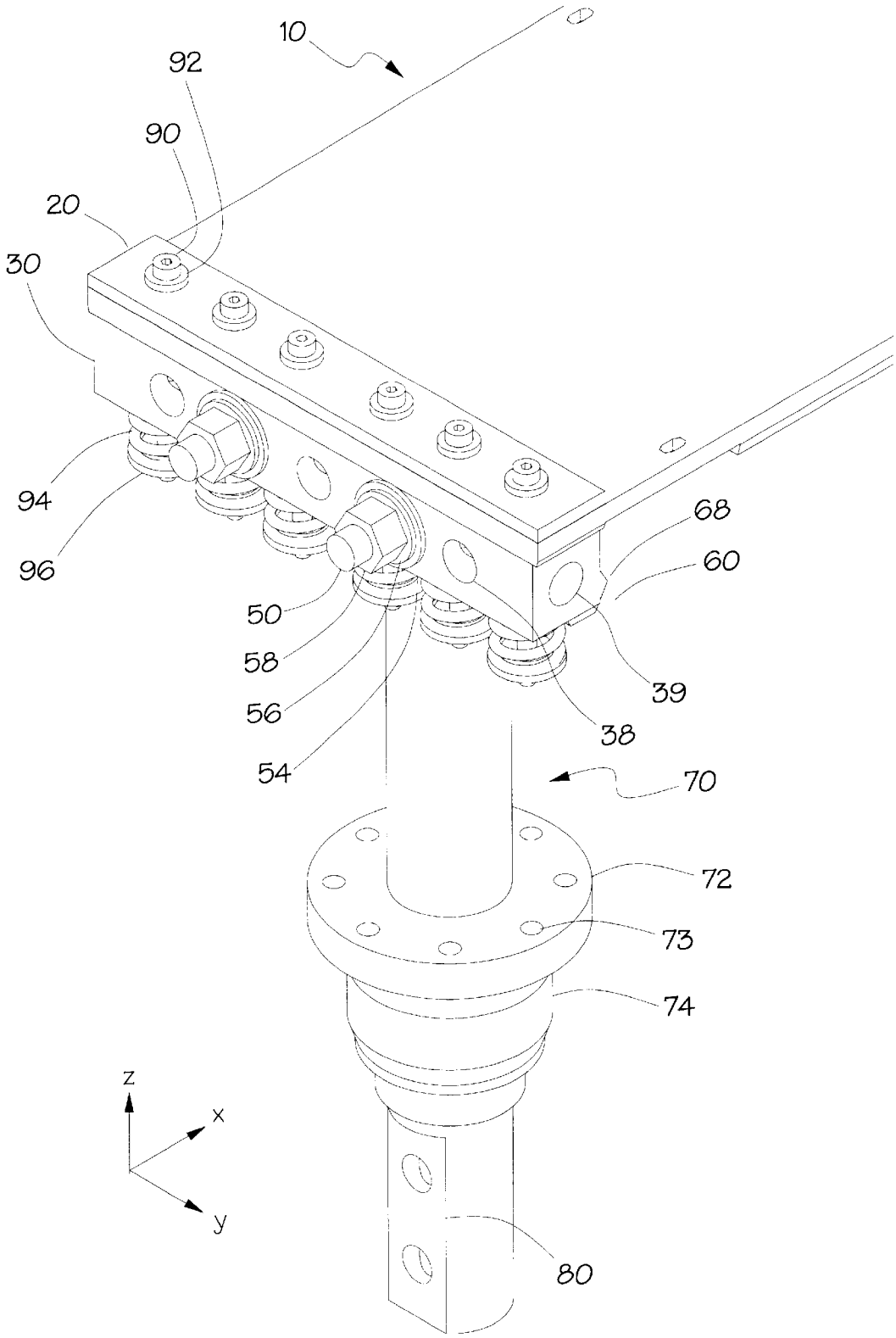
FIG. 1 is a perspective drawing of the upper side of an embodiment of an assembled heating element connector according to the present invention.
Figure 2:
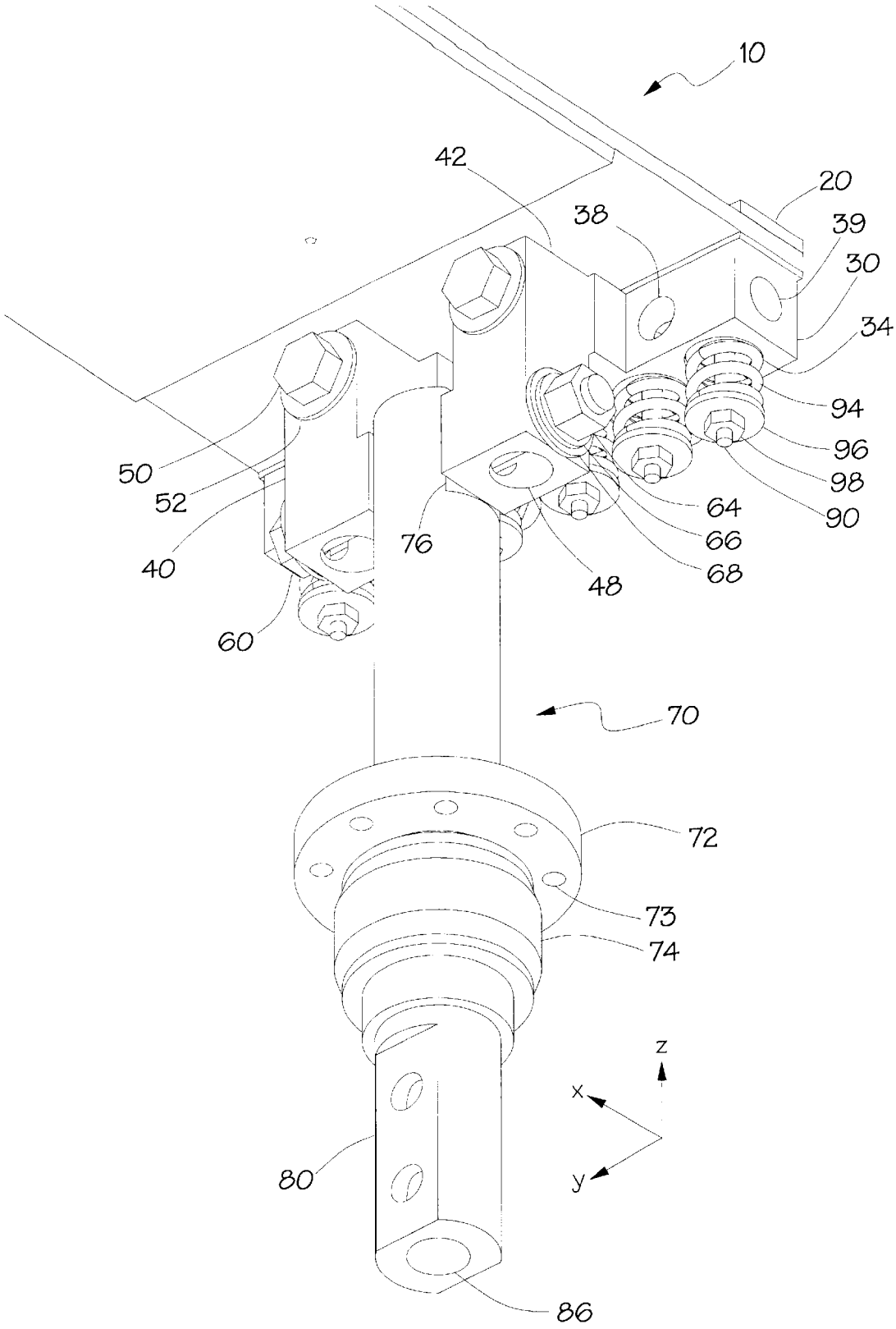
FIG. 2 is a perspective drawing of the lower side of an embodiment of an assembled heating element connector according to the present invention.
Figure 3:
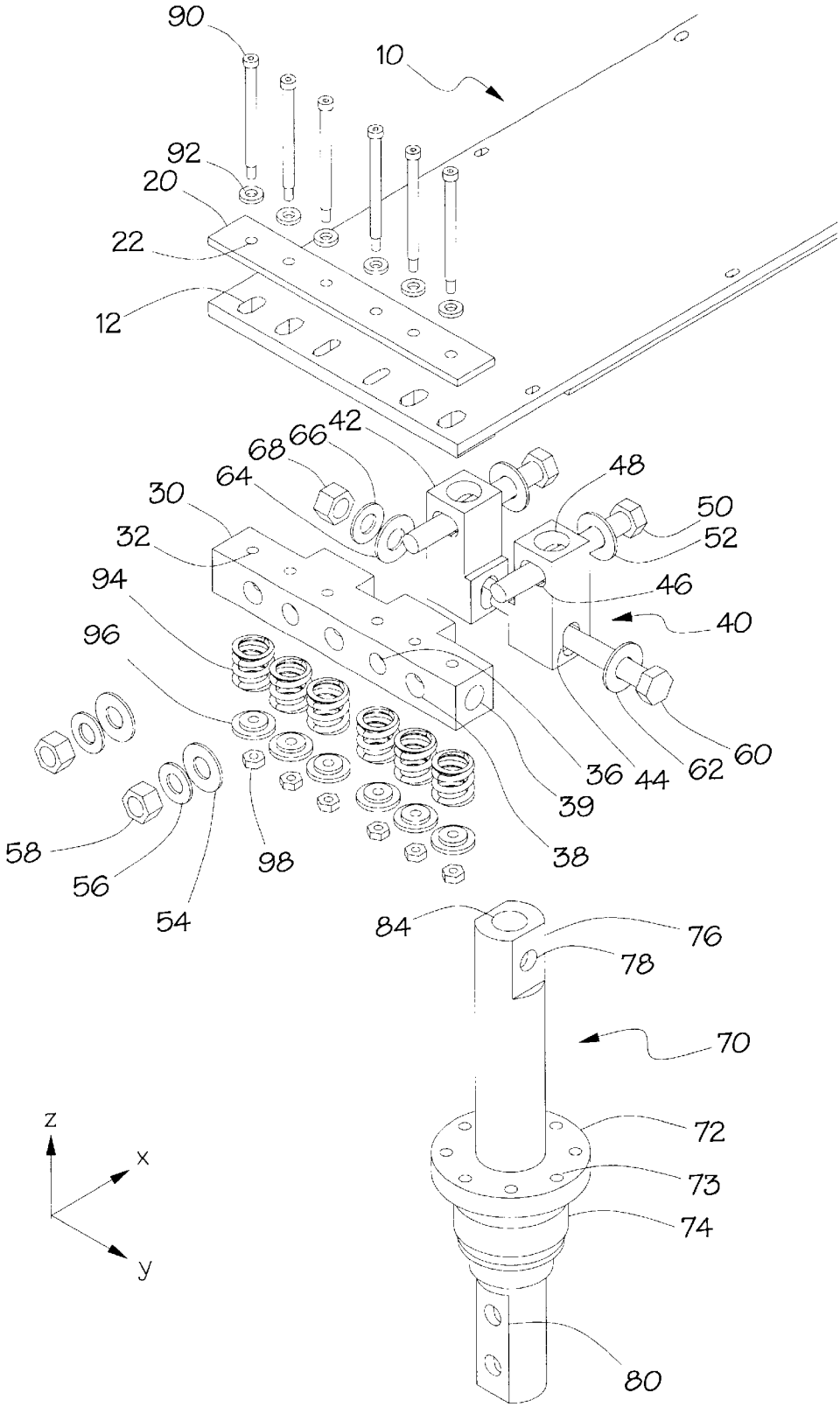
FIG. 3 is an exploded view of the upper side of the embodiment of a heating element connector of FIG. 1.
Figure 4:
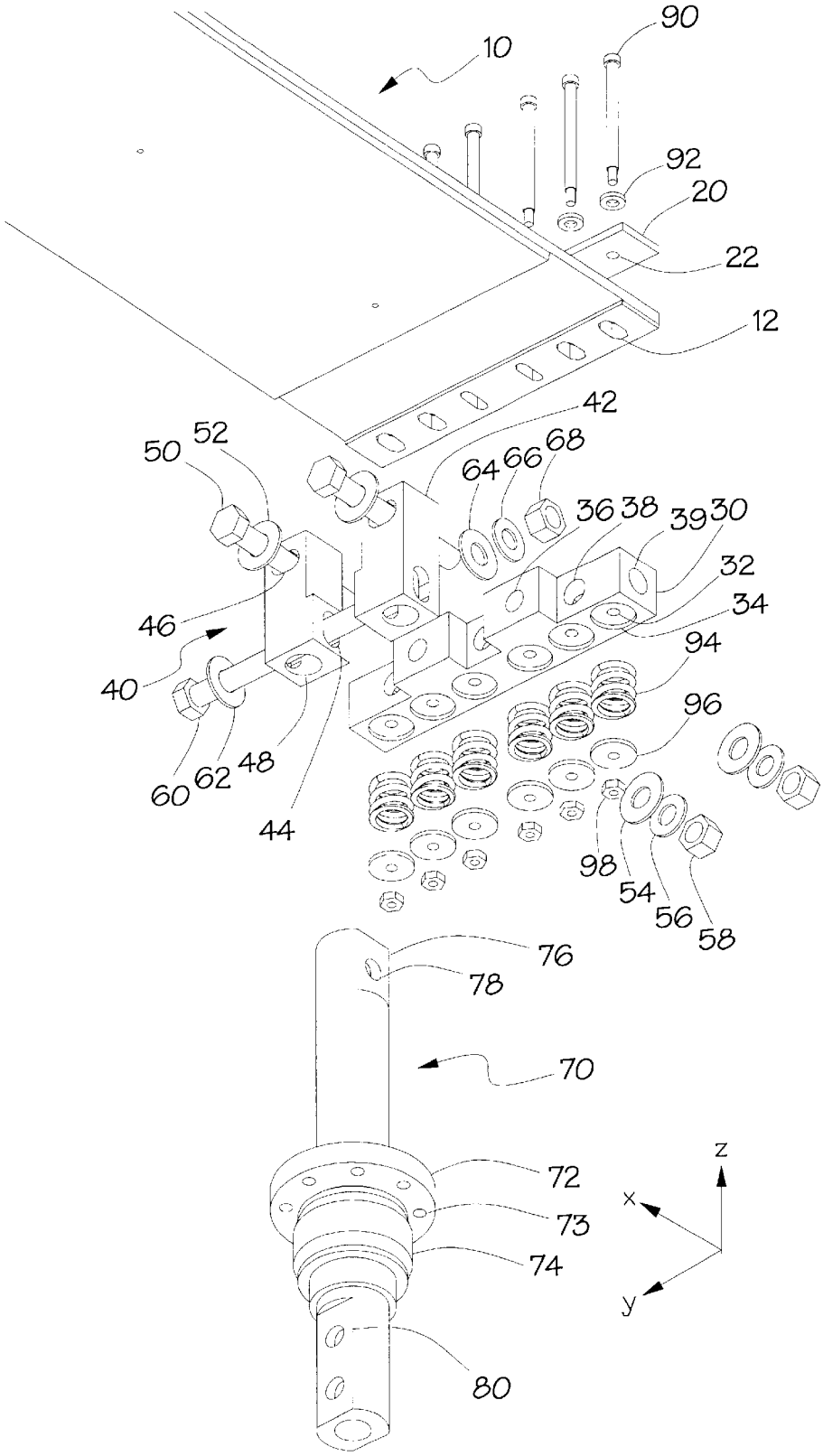
FIG. 4 is an exploded view of the lower side of the embodiment of a heating element connector of FIG. 2.

FIGS. 1 and 2 show an upper and a lower view of a heating element 10 coupled to an electrode 70 using an embodiment of the present invention. FIGS. 3 and 4 show the same embodiment in upper and lower exploded views. The figures include x, y, and z reference axes. It will be appreciated that the reference axes are provided only for the convenience of describing the figures and in no way limit the generality of the described invention.

The heating element 10 may be in the form of a generally rectangular sheet or plate having a length in the x direction, a width in the y direction, and a thickness in the z direction. The heating element may be of virtually any size and may be shaped in a variety of ways without affecting the present invention. In one embodiment, the length may be approximately 54 inches, the width approximately 10 inches, and the thickness in the area of connection approximately ½ inch. It will be appreciated that the present invention is applicable to electrical heating elements having the form of a generally rectangular sheet or plate made from a variety of materials with graphite being a preferred material.

The heating element 10 may include a plurality of slots 12 along each of two edges at the opposing ends of the length (shown) or width (not shown) of the heating element. The slots 12 may be oriented so that the lengths of the slots lie in the same direction as a line connecting the two slotted ends.

A plate 20 is assembled to one side of the heating element and an electrically conductive support block 30 is assembled to the other side. A spring loaded connection assembly passes through holes 22, 32 in the plate 20 and support block 30 and through the slots 12 in the heating element 10. Each of the spring loaded connectors may include a bolt or screw 90, a washer 92, a spring 94, a spring retainer 96, and a nut 98. By holding the heating element 10 between the plate 20 and the support block 30 with the spring loaded connectors, a highly compliant connection is created to the heating element. The compliant connection accommodates differences in thermal expansion along the z axis in the illustrated embodiment. The compliant connection also maintains good electrical contact between the heating element 10 and the support block 30 despite relative movement of the heating element.

The springs 94 in the spring loaded connectors may be of a material that retains its resilient properties over the operating temperature range of the heating element which may be from room temperature to 1000 degrees Celsius. The spring may be made of Inconel. The spring may provide a force of about 90 pounds at about ¼ inch deflection. The spring loaded connectors may be adjusted to provide various amounts of compressive force between the support block 30 and the heating element 10.

The elongation of the slots 12 allows the heating element 10 to move relative to the plate 20 and the support block 30 in the x direction in the illustrated embodiment. The freedom accommodates differences in thermal expansion along the x axis. This also accommodates manufacturing tolerances in the length of the heating element 10 and the distance between the support blocks 30.

The slots 12 may also be somewhat wider than the diameter of the screws 90 in the spring loaded connector thereby allowing the heating element freedom along the y axis in the illustrated embodiment. The width of the slots 12 accommodates differences in thermal expansion along the y axis. The width of the slots 12 in concert with the elongation of the slots accommodates manufacturing tolerances in the angular position of the support block 30 around the z axis.

The support block 30 may be connected to two connecting blocks 40, 42 by two screw connectors. Each of the screw connectors may include a screw or bolt 50, washers 52, 54, a lock washer 56, and a nut 58. The connecting blocks 40, 42 are connected to the support block 30 with the axis of the screw connectors oriented along the x axis in the illustrated embodiment. The screws 50 pass through slots 46 on at least one of the connecting blocks 40, 42 or the support block 30 with the slots allowing relative movement between the support block and the connecting blocks in the y direction. In the embodiment shown, the slots 46 are provided only in the connecting blocks 40, 42. In another embodiment (not shown) only a single connecting block may be used.

The connecting blocks 40, 42 are connected to an end of an electrode 70 by a screw connector. The screw connector may include a screw or a bolt 60, washers 62, 64, a lock washer 66, and a nut 68. The electrode 70 may include two flat faces 76 to support the connecting blocks 40, 42 on either side of the electrode. The bolt 60 passes through the slots 44 in each of the connector blocks 40, 42 and a hole 78 in the electrode. In another embodiment (not shown) the bolt may pass through a slot in the electrode and holes in each of the connector blocks. The connection between the electrode 70 and the connector blocks 40, 42 permits the support block 30 to be raised and lowered in the z direction relative to the electrode. This connection also permits the support block 30 to be rotated around the axis of the screw connector, parallel to the y axis. One of the connector blocks 40 may be raised or lowered relative to the other connector block 42 to rotate the support block 30 around an axis parallel to the x axis.

In the embodiment shown in the figures, the connector has three degrees of translational freedom and three degrees of rotational freedom allowing the support blocks 30 at each of the two ends of the heating element 10 to be adjusted to level and align the heating element as required and to hold the ends of the heating element between the support block 30 and the plate 20 without creating any stresses or strains in the heating element. The only force applied to the heating element 10 by the connector is the compressive force between the plate 20 and the support block 30 as controlled by the spring loaded connectors. It will be appreciated that the slots 12 in the heating element 10 can be dimensioned to accommodate a significant movement between the connector and the heating element due to the differences in thermal expansion. For a graphite heating element of approximately 4 feet in length between two electrodes supported in a cooled metal wall of a furnace, the graphite heating element may need to move 0.125 inches with respect to each connector when heated to a temperature of 1,000 degrees Celsius.

The current carrying members of the connector assembly may include bores to cool the connectors and improve conductivity because of the high currents carried by these components. Currents of several thousand amperes may be used to energize the graphite heating element 10. The support block 30 may include a length-wise bore 39. The support block may also include crosswise bores 38. The connector blocks 40, 42 may include a length-wise bore 48. The electrode 70 may include two axially bores 84, 86 with a web of material left between the two bores so that the electrode can provide a pressure-tight closure when passed through a wall of a pressure tight vessel such as a pressure/vacuum furnace. The electrode 70 may include an electrically isolated flange 72 for rigidly mounting the electrode through the wall of a pressure tight vessel.

Figure 5:
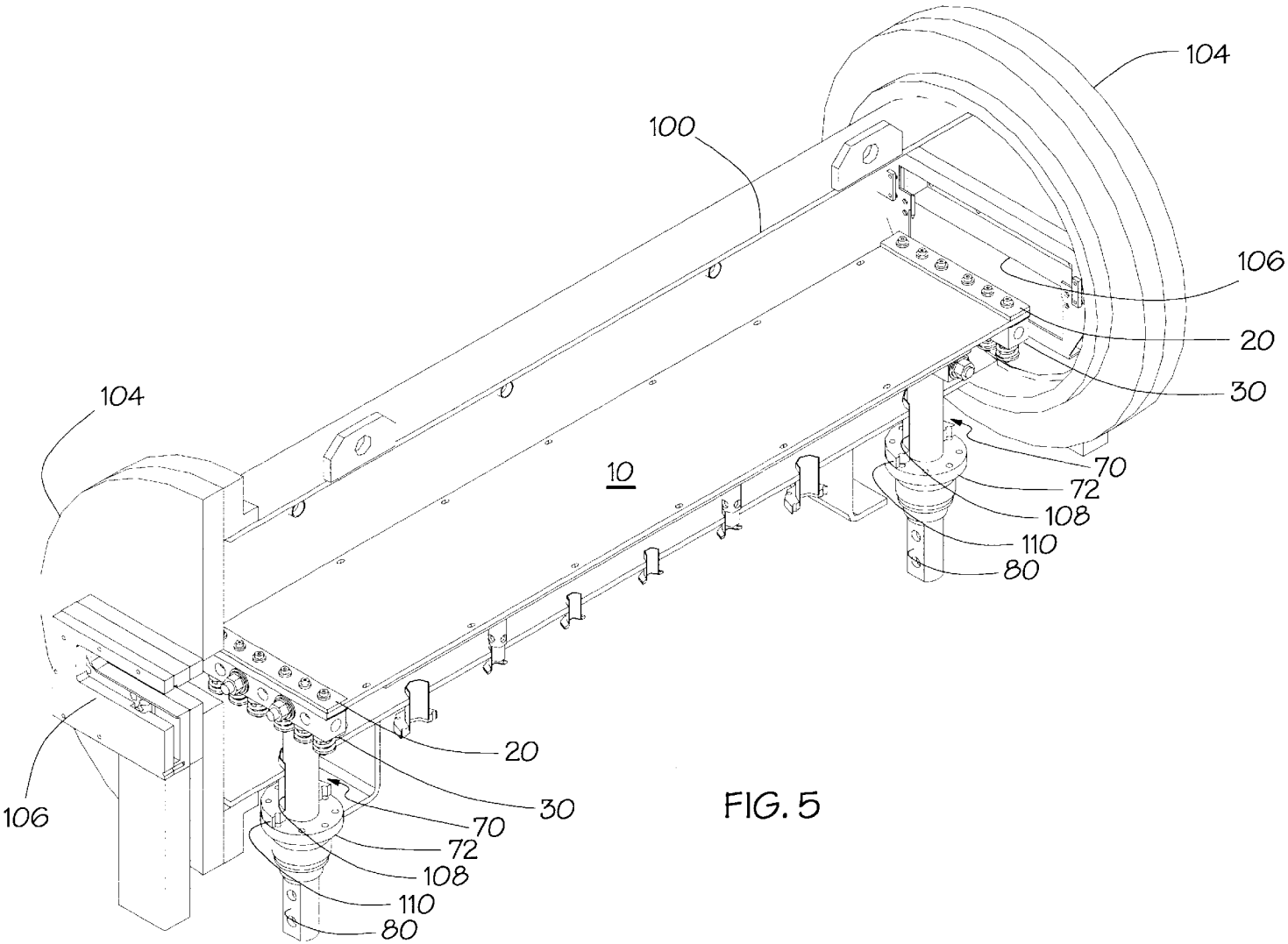
FIG. 5 is a perspective drawing of a pressure/vacuum furnace according to the present invention.

FIG. 5 is a perspective drawing of a pressure/vacuum furnace according to the present invention. The furnace includes a cylindrical wall 100, which may be a length of tubing, and two opposing ends 104 to form a pressure tight vessel. The front half of the wall 100 and the left end 104 have been cut away to show the arrangement of the heating element 10 and the electrodes 70 within the furnace. While a wall 100 in the form of a circular cylinder with ends in the form of flat discs is shown, it will be appreciated that the walls and ends of the of the furnace may take any of a variety of forms such as a rectangular cylinder for the walls or a hemispherical end. One or more sealable access doors 106 will typically be provided in the pressure tight vessel.

The wall 100 may include two tubes 108 that pass through the wall. A flange 110 is provided on the exterior end of each tube 108. The electrically isolated flange 72 of the electrode 70 is mounted to the flange 110 in the wall of the furnace with the conductive body of the electrode passing through the tube 108 into the interior of the furnace. This provides two external electrical terminals 80 for supplying an electrical current to the heating element 10 while maintaining the pressure integrity of the vessel.

It will be appreciated that the distance between the two electrodes 70 will change as the furnace is heated and cooled due to the thermal expansion of the wall 100 and that this thermal expansion is likely to be significantly different that the thermal expansion of the heating element 10 between the two electrodes. The highly compliant connection with the heating element 10 held between the plate 20 and the support block 30 by the spring loaded connectors, as described above, accommodates the differences in thermal expansion and maintains good electrical contact between the heating element 10 and the support block 30 despite relative movement of the heating element.

It will also be appreciated that it is likely that there will be some misalignment of the inner ends of the two electrodes 70 relative to one another due to the normal manufacturing tolerances. The connector structure described above provides up to three degrees of translational freedom and three degrees of rotational freedom for each support block 30 relative to the connected electrode 70. This allows any relative misalignment of the electrodes 70 and dimensional irregularities of the heating element 10 to be accommodated by the connector structure.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A device, comprising:

an electrical heating element having a length, a width, and an end across the width with a planar first surface and an opposing planar second surface that is substantially parallel to the first surface, the heating element defining a plurality of slot shaped openings that extend from the first surface to the second surface, each of the plurality of slot shaped openings having a length and a width, the length of each of the plurality of slot shaped openings being parallel to the length of the heating element;

a plate having a third surface and an opposing planar fourth surface that is in contact with the first surface of the heating element, the plate defining a plurality of openings that extend from the third surface to the fourth surface, the plurality of openings being substantially coincident with the adjacent plurality of slot shaped openings of the heating element;

an electrically conductive support block having a fifth surface and an opposing planar sixth surface that is in contact with the second surface of the heating element, the support block defining a plurality of openings that extend from the fifth surface to the sixth surface, the plurality of openings being substantially coincident with the adjacent plurality of slot shaped openings of the heating element;

an electrode that is electrically coupled to the support block; and, a plurality of spring loaded connectors, each of the plurality of connectors extending through one of the plurality of slot shaped openings of the heating element and the adjacent openings in the plate and in the support block to hold the plate and the support block resiliently in electrical contact with the heating element such that the heating element can move in the direction of its length relative to the plate and the support block.

2. The device of claim 1, wherein the support block has a planar seventh surface that is substantially perpendicular to the sixth surface, the device further comprising an electrically conductive connector block that is connected to the seventh surface of the support block by exactly one first bolt that is substantially perpendicular to the seventh surface, the connector block connected to the electrode by exactly one second bolt that is substantially perpendicular to the first bolt.

3. The device of claim 2, wherein the first bolt passes through a first slot in at least one of the connector block and the support block such that the support block can be moved in the direction of the width of the heating element relative to the electrode.

4. The device of claim 2, wherein the second bolt passes through a second slot in at least one of the connector block and the electrode such that a distance between the support block and the electrode can be changed.

5. The device of claim 1, wherein the support block has a planar seventh surface that is substantially perpendicular to the sixth surface, the device further comprising two electrically conductive connector blocks, each connector block being connected to the seventh surface of the support block by exactly one first bolt that is substantially perpendicular to the seventh surface, the two connector blocks being connected to the electrode by exactly one second bolt that is substantially perpendicular to each of the first bolts.

6. The device of claim 5, wherein each of the first bolts passes through a slot in one of the connector blocks such that the support block can be moved in the direction of the width of the heating element relative to the electrode.

7. The device of claim 5, wherein each of the first bolts passes through one of two slots in the support block such that the support block can be moved in the direction of the width of the heating element relative to the electrode.

8. The device of claim 5, wherein the second bolt passes through a slot in each of the two connector blocks such that a distance between the support block and the electrode can be changed.

9. The device of claim 5, wherein the second bolt passes through a slot in the electrode such that a distance between the support block and the electrode can be changed.

10. The device of claim 1, wherein the electrode further includes an electrically isolated flange for rigidly mounting the electrode through a wall of a pressure tight vessel.

11. The device of claim 1, wherein each of the plurality of spring loaded connectors has a shank portion located within one of the plurality of slot shaped openings of the heating element, each of the shank portions having a diameter that is smaller than the width of the slot shaped openings such that the heating element can rotate relative to the plate and the support block around an axis perpendicular to the length and the width of the heating element.

12. The device of claim 1, wherein each of the plurality of spring loaded connectors includes a coil spring for supplying a compression force.

13. The device of claim 1, wherein the heating element is a graphite heating element.

14. A device, comprising:

a heating means for converting electrical energy into heat, the heating means having a length, a width, and an end across the width with a planar first surface and an opposing planar second surface that is substantially parallel to the first surface;

a plate having a third surface and an opposing planar fourth surface that is in contact with the first surface of the heating means;

an electrically conductive support block having a fifth surface and an opposing planar sixth surface that is in contact with the second surface of the heating means;

an electrode that is electrically coupled to the support block;

a plurality of first means for holding the plate and the support block resiliently in contact with the heating means such that the heating means has a first degree of translational freedom in the direction of its length relative to the electrodes; and a second means for electrically connecting the support block to the electrode such that the heating means has a second degree and a third degree of translational freedom relative to the electrode, the three degrees of translational freedom being mutually orthogonal, and a second degree and a third degrees of rotational freedom relative to the electrode, the three degrees of rotational freedom having axes of rotation that are mutually orthogonal.

15. The device of claim 14, wherein the plurality of first means for holding are further such that the heating means has a first degree of rotational freedom about an axis perpendicular to the length and the width of the heating means.

16. The device of claim 14, wherein the electrode further includes an electrically isolated flange for rigidly mounting the electrode through a wall of a pressure tight vessel.

* * * * *